US006510408B1

(12) United States Patent
Hermansen

(10) Patent No.: US 6,510,408 B1
(45) Date of Patent: Jan. 21, 2003

(54) METHOD OF NOISE REDUCTION IN SPEECH SIGNALS AND AN APPARATUS FOR PERFORMING THE METHOD

(75) Inventor: Kjeld Hermansen, Gistrup (DK)

(73) Assignee: Patran ApS, Aalborg (DK)

( * ) Notice: Subject to any disclaimer, the term of this patent is extended or adjusted under 35 U.S.C. 154(b) by 0 days.

(21) Appl. No.: 09/462,232

(22) PCT Filed: Jul. 1, 1998

(86) PCT No.: PCT/DK98/00295

§ 371 (c)(1),
(2), (4) Date: Dec. 22, 1999

(87) PCT Pub. No.: WO99/01942

PCT Pub. Date: Jan. 14, 1999

(30) Foreign Application Priority Data

Jul. 1, 1997 (DK) ..... 0776/97

(51) Int. Cl.[7] ..... G10L 21/02
(52) U.S. Cl. ..... 704/233; 704/205
(58) Field of Search ..... 704/200, 207, 704/205, 208, 226, 219, 209, 227, 228, 233

(56) References Cited

U.S. PATENT DOCUMENTS 5,133,013 A * 7/1992 Munday ..... 704/226
5,742,927 A * 4/1998 Crozier et al. ..... 704/209
5,839,101 A * 11/1998 Vahatalo et al. ..... 704/217
5,933,495 A * 8/1999 Oh ..... 370/289
5,937,060 A * 8/1999 Oh ..... 370/286
6,175,602 B1 * 1/2001 Gustafsson et al. ..... 375/285
6,205,421 B1 * 3/2001 Morii ..... 704/226

FOREIGN PATENT DOCUMENTS

FR 2768547 * 9/1997 ..... G10L/3/02

* cited by examiner

*Primary Examiner*—Richemond Dorvil
(74) *Attorney, Agent, or Firm*—Dykema Gossett PLLC

(57) ABSTRACT

A method and apparatus for noise reduction in a speech signal wherein a first spectrum is generated on the basis of the speech signal and a second spectrum is generated as an estimate of the noise power spectrum. A third spectrum is generated by performing a spectral subtraction of the first and second spectra, and a resulting speech signal is generated on the basis of the third spectrum. A model-based representation describing the quasi-stationary part of the speech signal is generated on the basis of the third spectrum. The model-based representation is manipulated, and the resulting speech signal is generated using the manipulated model-based representation and a second signal derived from the speech signal.

18 Claims, 6 Drawing Sheets

METHOD OF NOISE REDUCTION IN SPEECH SIGNALS AND AN APPARATUS FOR PERFORMING THE METHOD

BACKGROUND OF THE INVENTION

1. Field of the Invention

The present invention relates to noise reduction in speech signals.

2. The Prior Art

Noise, when added to a speech signal, can impair the quality of the signal, reduce intelligibility, and increase listener fatigue. It is therefore of great importance to reduce noise in a speech signal in relation to hearing aids, but also in relation to telecommunication.

Various methods of noise reduction in a speech signal are known. These methods include spectral subtraction and other filtering methods, e.g., Wiener filtering. Spectral subtraction is a technique for reducing noise in speech signals, which operates by converting a time domain representation of the speech signal into the frequency domain, e.g., by taking the Fourier transform of segments of the speech signal. Hereby a set of signals representing the short term power spectrum of the speech is obtained. During the speech-free periods, an estimate of the noise power spectrum is generated. The obtained noise power spectrum is subtracted from the speech power spectrum signals in order to obtain a noise reduction. A time domain speech signal is reconstructed using the resulting spectrum, e.g., by use of the inverse Fourier transform. Hereby the time-domain signal is reconstructed from the noise-reduced power spectrum and the unmodified phase spectrum.

Even though this method has been found to be useful, it has the drawback that the noise reduction is based on an estimate of the noise spectrum and is therefore dependent on stationarity in the noise signal to perform optimally.

As the noise in a speech signal is often non-stationary, the estimated noise spectrum used for spectral subtraction will be different from the actual noise spectrum during speech activity. This error in noise estimation tends to affect small spectral regions of the output, and will result in short duration random tones in the noise reduced signal. Even though these random noise tones are often a low-energy signal compared to the total energy in the speech signal, the random tone noise tends to be very irritating to listen due to psycho-acoustic effects.

The object of the invention is to provide a method which enables noise reduction in a speech signal, and which avoids the above-mentioned drawbacks of the prior art.

SUMMARY OF THE INVENTION

The invention is based on the circumstance that a model-based representation describing the quasi-stationary part of the speech signal can be generated on the basis of a third spectrum, which is generated by spectral subtraction of a first spectrum generated on the basis of a speech signal and a second spectrum generated as an estimate of the noise power spectrum. The spectral subtraction enables the use of model-based representation for speech signals including noise, and the model-based representation of the quasi-stationary part of the speech signal enables an improved noise reduction compared to methods of prior art, as it enables use of a prior knowledge of speech signals.

This unconventional use of a combination of both traditional and model-based methods of noise reduction in a speech signal is advantageous, as it permits smooth manipulation of the speech signal in order to obtain improved noise reduction without artefacts.

As the model based representation is generated dynamically, i.e., on the fly, movements of the formants in the third spectrum will not affect the quality of the noise reduction, and the method according to the invention is therefore advantageous compared to methods of the prior art.

Preferably, the model-based representation can include parameters describing one or more formants in the third spectrum. This is advantageous as the formants, i.e., peaks in the signal spectrum, which are related to the speech, in a the third spectrum contains essential features of the speech signal, and as it is possible to manipulate the formants by using the parameters, and hereby to manipulate the resulting speech signal.

The parameters preferably reflect the resonance frequency, the bandwidth, and the gain at the resonance frequency of the formants in the third spectrum.

In a preferred embodiment, the manipulation can include spectral gaining, which is based on a structure parameters reflecting structure in the spectrum. Spectral gaining attenuates relatively broad fox wants since these cause unwanted artefacts. This method is based on the fact that man-made speech produces narrow formats in the absence of noise.

The structure parameter S can be preferably given by $S=B*G$, where B is the bandwidth ratio of the formants in the third spectrum, and G is the gain ratio of the formants in the third spectrum.

Noise reduction is preferably performed in said second signal. This is advantageous as noise will also be present in the second signal, and a noise reduction in this signal will therefore result in a noise reduction in the resulting signal.

The second signal can correspond to the speech signal. This is advantageous in some cases, e.g., when the signal/noise ratio approximately equals 0 dB.

The second signal can represent the residual signal, i.e., the non-stationary part of the speech signal such as information reflecting the articulation. This is advantageous in some cases, e.g., when the signal/noise ratio approximately equals 6 dB.

Various signal elements of the second signal, such as pitch pulses, stop consonants and noise transients, can be preferably amplified or attenuated. This is advantageous in some cases, e.g., when the signal/noise ratio approximately equals −6 dB.

The present invention also relates to an apparatus for noise reduction in speech signals.

The invention will be explained more fully by the following description with reference to the accompanying drawings.

BRIEF DESCRIPTION OF THE DRAWINGS

FIG. 5*b* shows some aspects from. FIG. 5*a* in a greater detail.

DETAILED DESCRIPTION OF THE PREFERRED EMBODIMENTS

Figure 1:
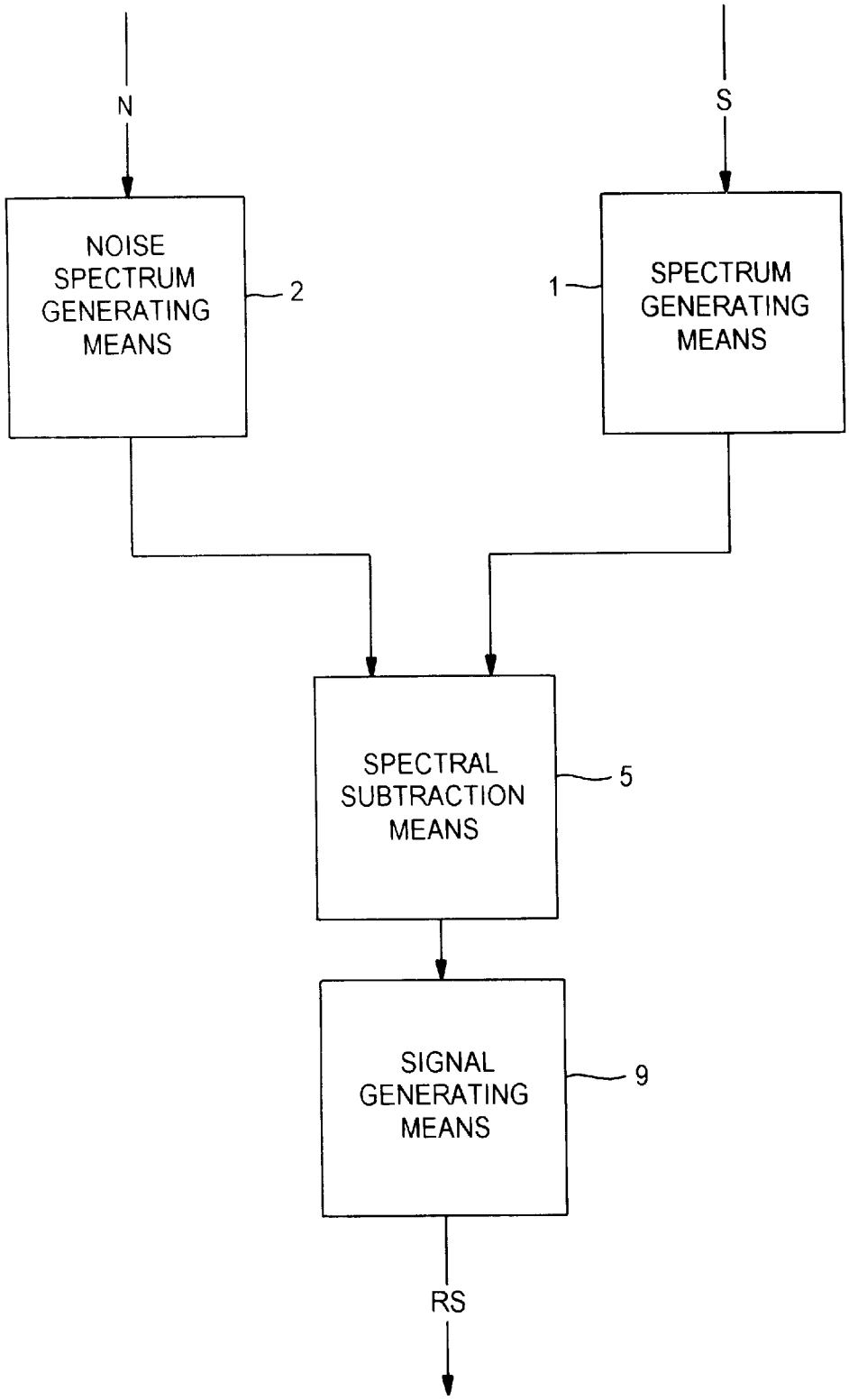
FIG. 1 (PRIOR ART)
FIG. 1 shows a schematic diagram of prior art.

The prior art is described with reference to FIG. 1. The figure illustrate an apparatus where a speech signal S is connected to the input terminal of a spectrum generating means 1. The output terminal of the spectrum generating means 1 is connected to a spectral. subtraction means 5. A measured noise signal N is connected to the input terminal of a noise spectrum generating means 2. The output terminal of the noise spectrum generating means 2 is connected to a second input terminal of the spectral subtraction means 5. The output terminal of the spectral subtraction means 5 is connected to the input terminal of a signal generating means 9. The signal generating means 9 is adapted to generate the resulting speech signal RS, which is connected to the output terminal.

At 1 segments of the speech signal including noise, S, in the time domain are transformed into a representation in the frequency domain, e.g. by use of the FFT (Fast Fourier Transform). During speech free periods an estimate of the noise power spectrum is calculated from a background noise signal, N, and stored at 2. The estimate of the noise power is then subtracted from the spectral representation of the speech signal resulting in yet another spectrum with a reduced amount of noise if a good estimate for the noise power spectrum could be obtained and the background noise has not changed that much since. This is done at 5. This procedure is often called 'Spectral Subtraction'. The resulting spectrum is then transformed back into the time domain at 9, e.g., by the inverse FFT, thereby generating the resulting speech signal, RS.

Figure 2:
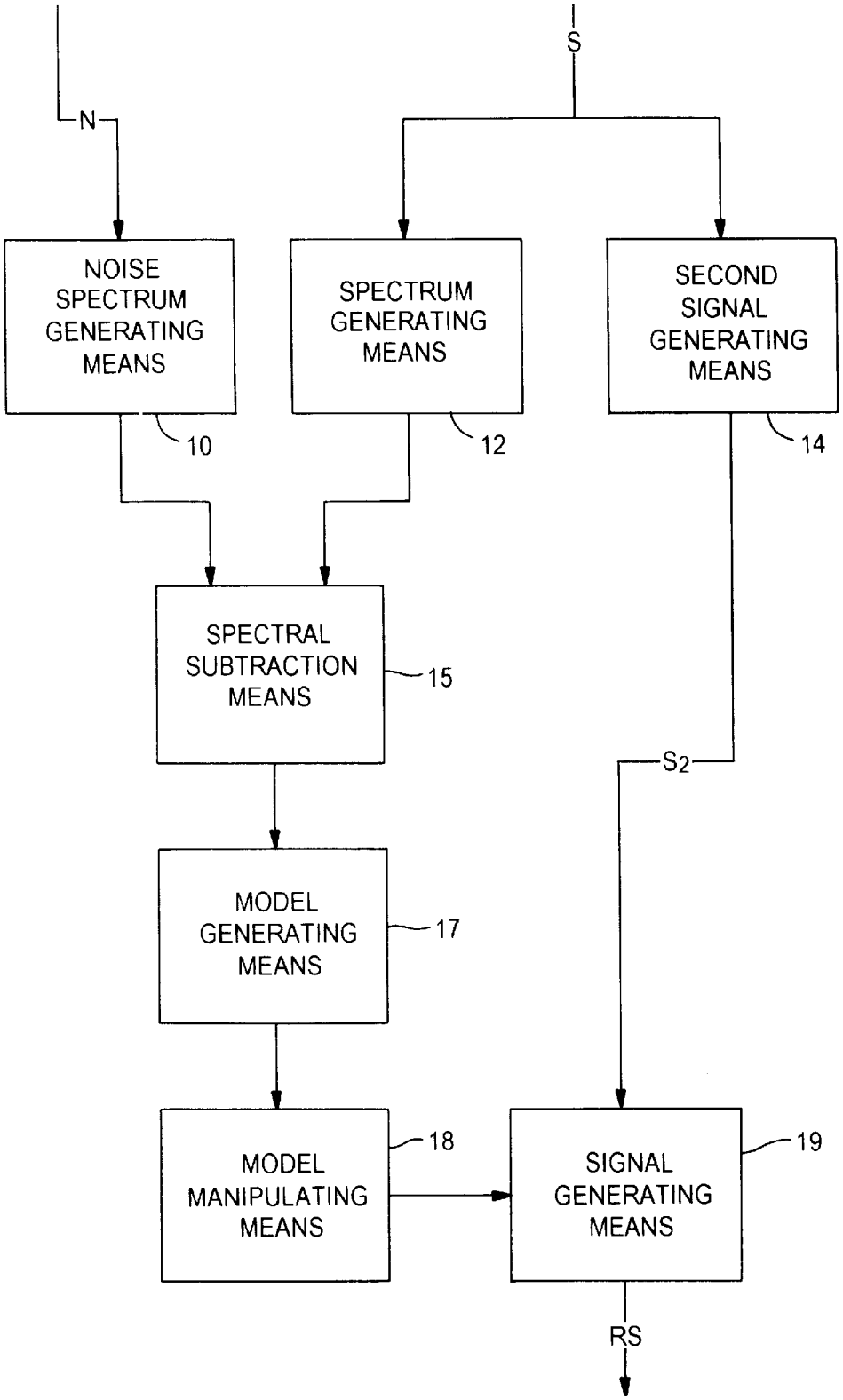
FIG. 2 shows a schematic diagram of one preferred embodiment of the present invention.

FIG. 2 schematically shows an improved method according to a preferred embodiment of the present invention. The figure illustrate an apparatus according to the invention, where a speech signal S is connected to the input terminal of a spectrum generating means 12. The output from the spectrum generating means 12 is connected to a first input terminal of a spectral subtraction means 15. The apparatus also includes a noise spectrum generating means 10 having a input terminal, which is connected to a measured noise signal N, and a output terminal, which is connected to a second input terminal of the spectral subtraction means 15. As shown on the figure, the apparatus also includes a model generating means 17, a model manipulating means 18, and a signal generating means 19, which are connected in series. A second signal generating means 14 has an input terminal, which is also connected to the speech signal, and an output terminal which is connected to a second input terminal of the signal generating means 19. The signal generating means 19 is adapted to generate the resulting speech signal RS.

At 10 an estimate of the noise power spectrum is calculated from a background noise signal, N, during speech free periods. The estimate is stored for later use. This estimate spectrum is called the second spectrum hereinafter. At 12 segments of the speech signal including noise, S, in the time domain are transformed into a spectral representation, e.g. by the FFT, in the frequency domain. This spectrum is called the first spectrum hereinafter. The second spectrum is then subtracted from the first spectrum at 15, resulting in a noise-reduced spectrum, called the third spectrum hereinafter. This result is not always sufficient or satisfactory as mentioned above. So, in accordance with this invention the third spectrum is used for generating a model based description of the speech signal. This is done at 17, and enables the use of the model based description in noisy environments. The combination of spectral subtraction reduces the noise, thereby enabling the use of a model based description to gain even greater noise reduction.

Figure 3:
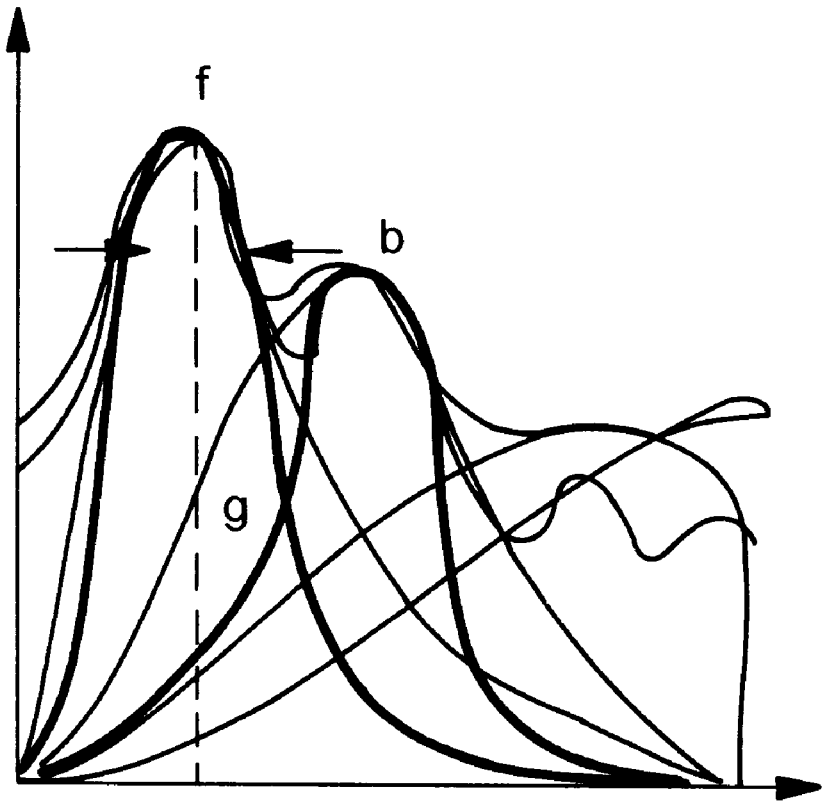
FIG. 3 illustrates some formants of a speech signal along with some parameters describing one formant.

The model based description ensures simple control of formants, and thereby the essential features of the speech signal, through parameters like the resonance frequency (f), the bandwidth (b) and the gain (g) of each formant (see also FIG. 3). The model can be derived using known methods, e.g. the method used in the Partran Tool, which is described in articles by U. Hartmann, K. Hermansen and F.K. Fink: "Feature extraction for profoundly deaf people", D.S.P. Group, Institute for Electronic Systems, Alborg University, September 1993, and by K. Hermansen, P. Rubak, U. Hartman and F. K. Fink: "Spectral sharpening of speech signals using the partran tool", Alborg University.

These three parameters, f, b, and g, for each relevant formant capture all the essential features of the quasistationary part of a speech signal. These parameters are manipulated at 18 in order to reduce artefact sounds, e.g. "bath tub" sounds, and to reduce the noise even further. Artefacts are distorted sounds with a low signal power and will typically not be removed by any methods according to the prior art. However, these sounds have been found to be very disturbing and irritating to the human ear, which is well-known from various psycho-acoustic tests. The manipulated parameters are then used together with a signal $S_2$ which is derived from the original speech signal at 14, in order to obtain a time varying speech signal with reduced noise and artefacts. The resulting f, b, and g parameters are used to form the pulse response for the synthesis filter 19. Convolution of signal $S_2$ and said pulse response forms the resulting speech signal RS.

FIG. 3 illustrates the relation between the individual formants and the parameters f, b and g in greater detail.

In a spectrum of a human speech signal there will always be formants present in the absence of noise, and these will typically have the largest (and the most important formant with respect to intelligibility) formant at the lowest frequency, while the additional formants typically have a decreasing amplitude as their resonance frequency gets bigger. The fact that the biggest formant carries quite a lot of the relevant information enables a human being to understand the speech even if all the other formants have "drowned" in noise.

Due to the fact that human speech incorporates a given structure for physiological reasons, and the fact that 'ordinary' background noise (e.g., white or pink noise) is highly disorganized/unstructured (A spectrum showing "ordinary" background (e.g., white) noise would consist of all frequencies present with more or less the same a amplitude), a given parameter reflecting the structure of a given sound/speech can characterize the amount of noise present in that particular sound/speech. If the sound/speech incorporates a high level of structure, then the signal does not contain much noise, since noise is unstructured. A parameter is used in order to describe the structure in the speech signal. The but one disclosed in this embodiment has been found to be a good and reliable choice. This choice is one of perhaps many and should not limit the present invention. The parameter used in this invention is called STRUK and is defined as:

$$STRUK = \frac{\max(h;)}{\min(h, 1.)} \frac{\max(gl)}{\min(g, j)}$$

that is the ratio of the maximum to the minimum value of all of the bandwidths for the available formants multiplied by the ratio of the maximum to the minimum value of all of the gain values for the available formants. In this particular embodiment b is given at the 3 dB attenuation from the resonance frequency and g is given at the resonance frequency. Other choices will be apparent to one skilled in the art. The basic idea of spectral gaining is to "punish" great bandwidths, as such are indicators of a missing structure. If STRUK is large (e.g. 100), the spectrum holds little noise, and if STRUK is relatively small (e.g., 5) the spectrum holds much noise.

FIG. 3 shows two formants (the two to the left) with a resulting model description together with two other formants (the two to the right) that are 'drowned' in noise. Due to the fact described above the model description will be perceived as quite good even though only two formants are included in the model. This makes the method according to the present invention robust.

Figure 4B:
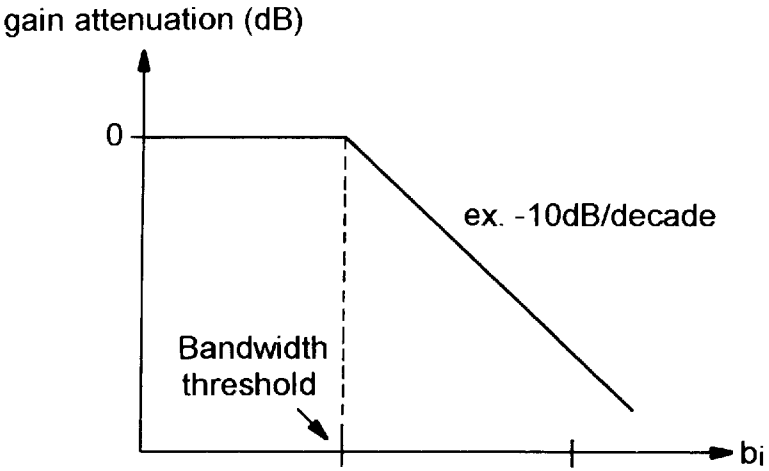
FIG. 4*b* shows the gain attenuation factor as a function of the bandwidth threshold.
Figure 4A:
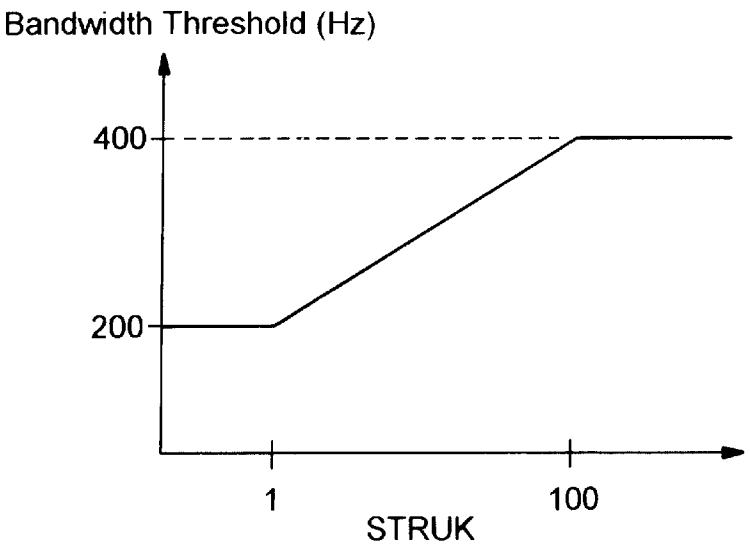
FIG. 4*a* shows the dependency between the structure parameter, STRUK, and the bandwidth threshold.

The parameter STRUK gives an easily modifiable one-valued parameter to determine the level of noise still present in the third spectrum. The model description makes it easy to modify the spectrum in order to remove unwanted artefacts and noise. This is done through the complete control of the parameters describing the formants (f, b and g). One way to reduce the noise is by 'punishing' formants with a relatively broad bandwidth by attenuating these, since it is in the nature of man-made sound that the formants are relatively narrow. The attenuation is done by using the parameter STRUK and the two relations shown in FIGS. 4*a* and 4*b*, which show a bandwidth threshold as a function of STRUK (FIG. 4*a*) and the gain attenuation as a function of the bandwidth threshold (FIG. 4*b*). Here it is shown that for a large value of STRUK (little noise) the bandwidth threshold is relatively large (e.g. 400 Hz), and thus the gain attenuation only attenuates relative broad formants. For a small value of STRUK (much noise) the bandwidth threshold is relatively small (e.g. 200 Hz) and the gain attenuation attenuates formants even when they are not very broad. That broad formants are attenuated can be seen in FIG. 3. Often it will be the case that the low frequency formants will survive the attenuation, which is desirable since these contain the most information relevant to the human ear, removing the broad formants in the process, which is desirable as well since these broad formants will often be perceived as artefacts by the human ear.

Again the model based approach with its small number of parameters ensures that a modification can be quite simple in order to obtain a noise reduction and/or artefact removal. The model based approach further has the advantage that if one has to transmit a speech signal, then the amount of data needed is greatly reduced by only having a small number of parameters describing the formants and thereby the speech signal.

Figure 5A:
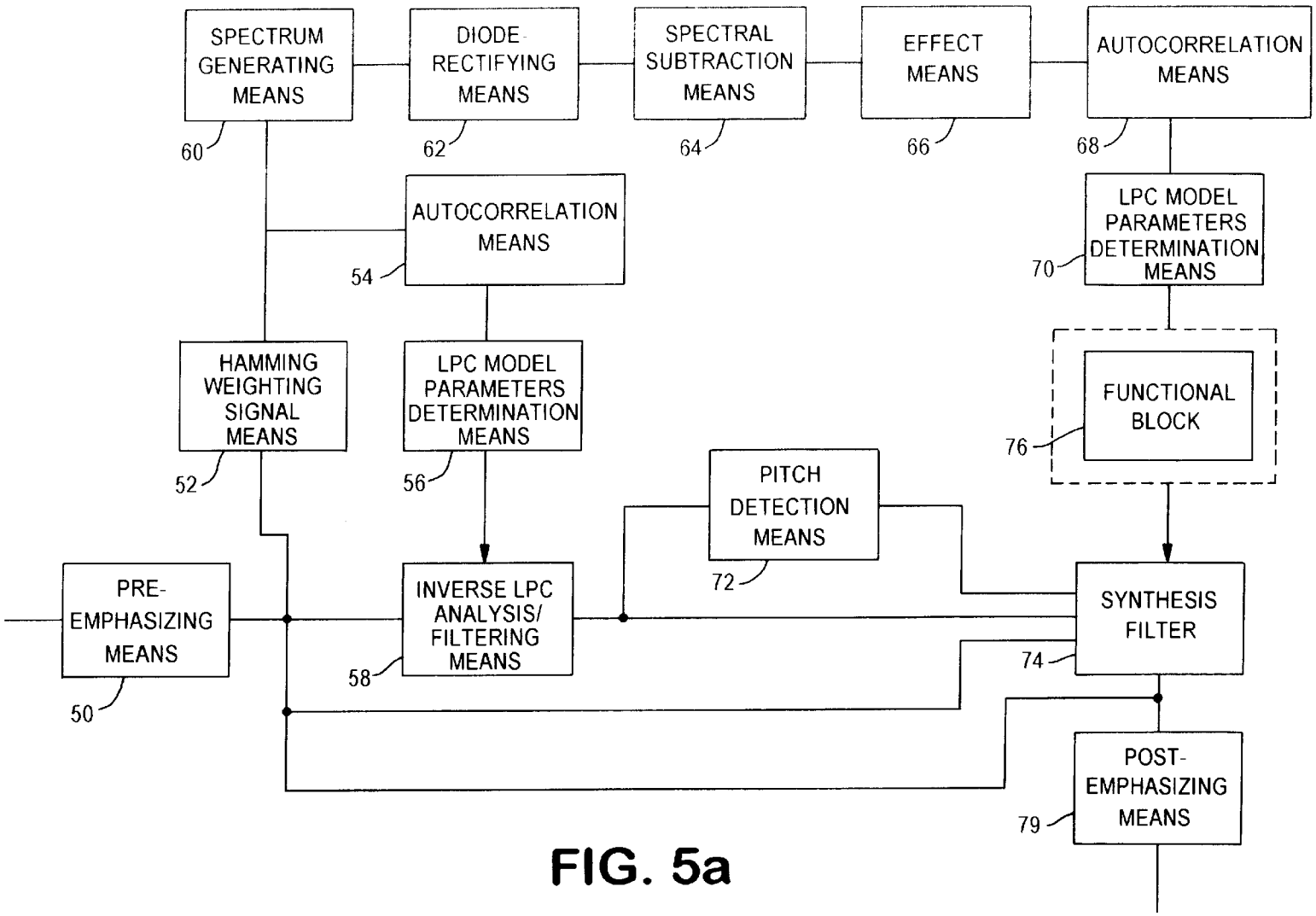
FIG. 5*a* is a block diagram of an apparatus utilizing the method according to the invention.

FIG. 5*a* illustrates an apparatus according to the invention, where a speech signal connected to the input terminal of pre-emphazising means 50. The output terminal is connected to a input terminals of Hamming weighting signal means 52, inverse LPC analysis/filtering means 58, and to a first input terminal of the synthesis filter 74, and the post-emphasizing means 79 adapted to compensate for the effect of the pre-emphasizing means 50 mentioned previously. The output terminal of the Hamming weighted signal means 52 is connected in series to the spectrum generating means 60 adapted, diode-rectifying means 62, spectral subtraction means 69, effect means 66, autocorrelation means 68, LPC model parameters determination means 70, the functional block 76, and to a second input terminal of the synthesis filter 74 and to the input terminal of the autocorrelation means 54. The output terminal of the autocorrelation means 54 is connected to LPC model parameters determination means 56. The LPC model parameters are connected to the inverse LPC analysis/filtering means 58. The apparatus further comprises a pitch detection means 72 with an input and an output terminal connected to the output terminal of the inverse LPC analysis/filtering means 58 and to a third input terminal of the synthesis filter 74 respectively. The synthesis filter 74 is adapted to select an input signal from one of the input terminals dependent on the noise level. The selected signal is called the second signal hereinafter. The selection can be performed in several ways. Noise reduction means can be used in order to obtain additional noise reduction in said second signal using known methods if desired.

Figure 5B:
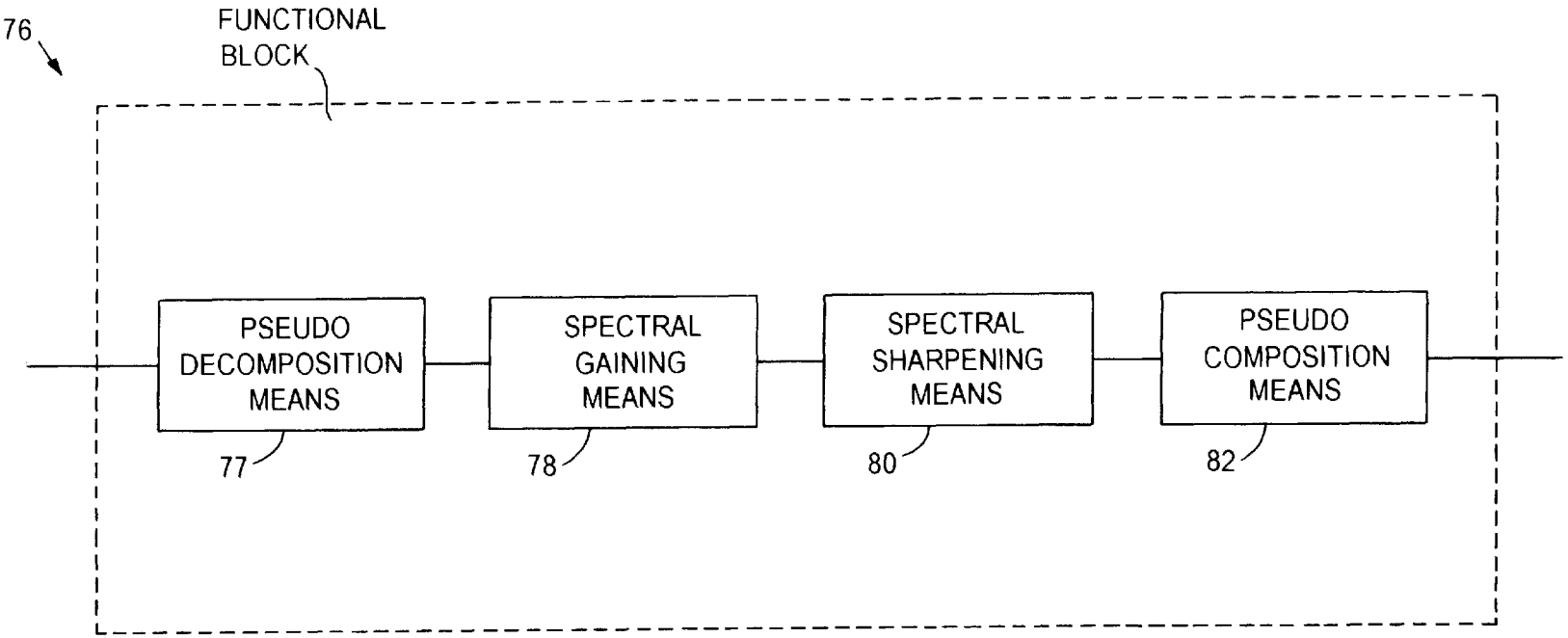

FIG. 5*b* illustrates in greater detail the functional block 76, where the input signal is connected in series to: pseudo decomposition means 77, spectral gaining means 78, spectral sharpening means 80 and pseudo composition means 82.

FIGS. 5*a* and 5*b* illustrate a block diagram of an apparatus utilizing the described method. The signal to be processed is given as x=s+n, where s and n is the signal and noise component, respectively. The signal is pre-emphazised at 50 in order to emphasize signal components with a high frequency in order to be able to access the important information present in these signal components that have a relatively low power.

The basis for an improvement in the SNR (signal to noise ratio) of an observed signal is the presence of one observed signal (from one microphone). The separation of the signal component and the noise component must thus be based on some knowledge of the signal component as well as the noise component. The overall idea of the invention is the utilization of the inertia conditioned partial stationarity of man-made sounds, as regards both articulation and intonation. The additive noise component, n, is assumed to be "white", pink or a combination thereof, and partly stationary in the second order statistics, but does not contain stationary harmonic components.

The basic approach is a separation of the articulation and intonation components via inverse LPC analysis/filtering 58. This ensures that the residual signal becomes maximally "white" and just contains—in terms of information—intonation components whose variation is assumed to be partly stationary, as mentioned before.

The determination of the articulation components depends on the strength of the noise, a distinction being made between three stages, viz. weak, intermediate and strong noise corresponding to an SNR of +6 dB, 0 dB and −6 dB, respectively.

For weak noise, the model parameters (LPC) 56 are determined on the basis of the autocorrelation function derived directly from the Hamming weighted signal 52 by the autocorrelation means 54, and non-linear spectral gaining is performed (see the following) in the spectral gaining means 78 according to the PARTRAN concept, see EP publication no. 0 796 489.

For the intermediate and strong noise situation, an indirect method is used for the determination of the autocorrelation function, which is still the basis for the model based description of articulation.

The indirect determination of the autocorrelation function is based on the relationship between power spectrum and autocorrelation (they are the Fourier transforms of each other). The Hamming weighted signal is Fourier-transformed with 512 points at 60 and diode-rectified at 62 with a given time constant. The minimum value of this signal is determined and subtracted from the diode rectified amplitude spectrum, (where the appearance of the noise spectrum is known a priori, arbitrary noise spectra may be subtracted here. The knowledge may be obtained if it is possible to identify phases in which the signal component is not present) thereby generating an amplitude spectral subtracted spectrum 64 which, following squaring, is inverse-Fourier-transformed with a view to determining the autocorrelation function 68. An effect means perform said squaring. By using the autocorrelation the LPC coefficients can be determined 70. These coefficients are used in a pseudo decomposition 77 in order to identify the f, b and g parameters. Then non-linear spectral gaining 78 is performed according to the PARTRAN concept followed by spectral sharpening 80 and pseudo composition 82 in order to obtain a spectrum from the model based description.

In all three cases of noise a model based (LPC) description of the articulation is provided. This model spectrum forms the basis for the calculation of the characteristic parameters of the energy maxima, viz. f, b and g parameters for each formant.

In connection with the weighting of these energy maxima a control parameter STRUK is developed (see above), indicating the degree of structure in the observed signal. This parameter is used for spectral gaining 78 according to the PARTRAN concept (see EP publ. no. 0 796 489).

The bandwidth threshold for reduction in the gain is controlled by the parameter STRUK as mentioned above.

The bandwidth threshold changes linearly in the region "intermediate". Each energy maximum is now subjected to gain adjustment depending on the current bandwidth and the current bandwidth threshold.

Artefacts in the form of the well-known "bath tub sounds" are eliminated hereby. After spectral gaining 78, spectral sharpening 80 is performed, comprising adjusting the bandwidth of the energy maxima by the factor band fact.

The thus modified f, b and g parameters (f being unchanged here) are used for forming second order resonators with zero points positioned in Z=1 and Z=−1. The pulse response of these resonators coupled in parallel and with alternating signs are used as FIR filter coefficients in the synthesis filter 74 (4-fold interpolation is performed).

Input signals to the synthesis filter 74 depend on the degree of the noise, a distinction being made here again between weak, intermediate and strong noise.

For weak noise, the residual signal from the inverse filtering 58 is used.

For intermediate noise, the input signal to the inverse filter 58 is used (the pre-emphasized observed signal) This results in a natural/inherent spectral sharpening, beyond the one currently performed in the PARTRAN transposition.

In case of strong noise, the jitter on the pulse of the residual signal is of such a nature/size that none of the above signals can be used as input to the synthesis filter 74. It is turned to account here that the intonation of man-made sounds is partly stationary, which is utilized in a modified pitch detection 72 based on a long observation window. A voiced sound detection determines whether pitch is present, and if so, a residual signal consisting of unit pulses of mean spacing is phased in.

As a result, the jitter is reduced significantly, and the synthesized signal is less corrupted by noise.

The basic ideas of the described method is to focus on quasi-stationary components in the observed signal. The method identifies these components and "locks" to them as long as they have a suitable strength and stationarity. This applies to both articulation and intonation components. Generally, artefacts are avoided hereby in connection with the filtering of the noise components. Many psycho-acoustic tests indicate that it is related methods which man uses inter alia in noisy environments.

As mentioned before, the method has been developed on the assumption of one observed signal. In the situation where two or more microphones are possible, this per se can give a noise reduction for the noise components in the two signals which correlate with each other. The remaining noise components may subsequently be eliminated via the described method.

Although a preferred embodiment of the present invention has been described and shown, the invention is not limited to it, but may also be embodied in other ways within the scope of the subject-matter defined in the appended claims, for example increase in speech intelligibility/speech comfort by manipulation/weighting of the formants in accordance with their strength/frequency or elimination of speaker dependent components in the speech signal, while maintaining speech intelligibility (speaker scrambling/encryption).

I claim:

1. A method of noise reduction in a speech signal, wherein a first spectrum is generated on the basis of the speech signal, a second spectrum is generated as an estimate of the noise power spectrum, a third spectrum is generated by performing a spectral subtraction of said first and second spectra, and a resulting speech signal is generated on the basis of said third spectrum, and whenrin a model based representation describing the quasi-stationary part of the speech signal is generated on the basis of the third spectrum, said model based representation is manipulated, and said resulting speech signal is generated using said manipulated model based representation and a second signal derived from said speech signal.

2. A method according to claim 1, wherein said model based representation includes parameters describing one or more formants in said third spectrum.

3. A method according to claim 2, wherein said parameters reflect the resonance frequency, the bandwidth, and the gain at the resonance frequency of said formants in said third spectrum.

4. A method according to claim 1, wherein said manipulation includes spectral gaining, which is based on a structure parameter S reflecting the structure in the spectrum.

5. A method according to claim 4, wherein said structure parameter S is given by S=B*G, where B is the bandwidth ratio of said formants in said third spectrum, and G is the gain ratio of said formants in said third spectrum.

6. A method according to claim 1, wherein noise reduction is performed in said second signal.

7. A method according to claim 1, wherein said second signal corresponds to said speech signal.

8. A method according to claim 1, wherein said second signal represents the residual signal.

9. A method according to claim 8, wherein various signal elements of said second signal, such as pitch pulse, stop consonants and noise transients, are amplified or attenuated.

10. An apparatus for noise reduction in a speech signal, comprising spectrum generating means (1,12) adapted to generate a first spectrum on the basis of the speech signal, noise spectrum generating means (2,10) adapted to generate a second spectrum as an estimate of the noise power spectrum, special subtraction means (5,15) adapted to generate a third spectrum by performing spectral subtraction of said first and second spectra, and signal generating means (9,19) adapted to generate a resulting speech signal on the basis of said third spectrum, said apparatus further comprising:

model generating means (17) adapted to generate a model based representation describing the quasi-stationary part of the speech signal on the basis of the third spectrum, model manipulating means (18) adapted to manipulate said model based representation, a second signal generating means (14) adapted to derive a second signal from said speech signal, and wherein said signal generating means (19) generates the resulting speech signal using said manipulated model based representation and second signal.

11. An apparatus according to claim 10, wherein said model generating means (17) generates a model which includes parameters describing one or more formants in said third spectrum.

12. An apparatus according to claim 11, wherein said parameters reflect the resonance frequency, the bandwidth, and the gain at the resonance frequency of said formants in said third spectrum.

13. An apparatus according to claim 10, wherein said model manipulating means (18) forms a structure parameter S which reflects the structure in the spectrum, and performs spectral gaining based on said structure parameter S.

14. An apparatus according to claim 13, wherein said structure parameter S is given by S=B*G, where B is the bandwidth ratio of said formants in said third spectrum, and G is the gain ratio of said formants in said third spectrum.

15. An apparatus according to claim 10. wherein the apparatus further comprises noise reduction means which performs noise reduction in said second signal.

16. An apparatus according to claim 10, wherein said speech signal is used as said second signal.

17. An apparatus according to claim 10, wherein the residual signal is used as said second signal.

18. An apparatus according to claim 17, further comprising means (72) to amplify or attenuate various signal elements of said second signal, such as pitch pulses, stop consonants and noise transients.

* * * * *

UNITED STATES PATENT AND TRADEMARK OFFICE

CERTIFICATE OF CORRECTION

PATENT NO. : 6,510,408 B1
APPLICATION NO. : 09/462232
DATED : January 21, 2003
INVENTOR(S) : Hermansen It is certified that error appears in the above-identified patent and that said Letters Patent is hereby corrected as shown below:

On the Title page, item [73] insert

[73] Partran ApS, Aalborg (DK)

Signed and Sealed this

Twelfth Day of August, 2008

JON W. DUDAS
*Director of the United States Patent and Trademark Office*